United States Patent [19]

Kumata

[11] 4,184,319

[45] Jan. 22, 1980

[54] DIGITAL DISPLAY TYPE ELECTRONIC TIME PIECE

[75] Inventor: Kiyoshi Kumata, Tenri, Japan

[73] Assignee: Sharp Kabushiki Kaisha, Osaka, Japan

[21] Appl. No.: 814,418

[22] Filed: Jul. 11, 1977

[30] Foreign Application Priority Data

Jul. 7, 1976 [JP] Japan ..... 51-81328

[51] Int. Cl.[2] ..... G04B 19/24; G04C 17/02

[52] U.S. Cl. ..... 58/50 R; 58/58; 58/23 A

[58] Field of Search ..... 58/50 R, 4 R4 A, 153, 58/58, 23 R

[56] References Cited

U.S. PATENT DOCUMENTS

| | | | |
|---|---|---|---|
| 3,789,603 | 2/1974 | Uhrentechniker | 58/58 |
| 3,803,827 | 4/1974 | Roberts | 58/58 |
| 3,971,012 | 7/1976 | Morokawa | 58/50 R |
| 4,040,245 | 8/1977 | Chetelat | 58/4 A |
| 4,065,916 | 1/1978 | Leuschner | 58/23 R |

*Primary Examiner*—Gene Z. Rubinson
*Assistant Examiner*—William L. Feeney
*Attorney, Agent, or Firm*—Birch, Stewart, Kolasch and Birch

[57] ABSTRACT

A digital display type electronic watch, comprising a display having four or six digit display positions, two of which are adapted to selectively display the numeral or alphabet characters and the other of which are adapted to display the numeral characters, a current time information signal generator for generating an hour information signal and a minute information signal, a current date information signal generator for generating a day of the month information signal, a day of the week information signal and a month signal, a mode selector for selecting a current time display mode for displaying the current hour and minute by the display using the numeral characters in response to the hour and minute signals, a first current date display mode for displaying the current day of the week by the said alphanumeric character displaying positions of the display using the alphabet characters in response to the day of the week signal and a second current display date mode for displaying the current month by the said alphanumeric character displaying positions of the display using the alphabet characters in response to the month signal, the current day of the month being displayed by the remaining digit positions using the numeral characters.

39 Claims, 13 Drawing Figures

JA FE MA AP MY

JU JL AU SE OC

NO DE (a) ENGLISH

JA FE MA AV MI

JU JI AO SE OC

NO DE (b) FRENCH (a) ENGLISH (b) FRENCH (a) ENGLISH (b) FRENCH

DIGITAL DISPLAY TYPE ELECTRONIC TIME PIECE

BACKGROUND OF THE INVENTION

1. Field of the Invention

The present invention relates to a digital display type electronic watch. More specifically, the present invention relates to an improvement in a digital display type electronic watch capable of displaying the current time and date information.

2. Description of the Prior Art

A typical conventional digital display type electronic watch comprises six or four digit display positions each adapted for displaying a selected numeral, such that the current time information is displayed. Such six digit display positions are usually used such that the most significant two digit positions are allotted to indicate hour information, the middle significant two digit positions are allotted to indicate minute information and the least significant two digit positions are allotted to indicate second information. Similarly, such four digit positions are typically used such that the more significant two digit positions are allotted to indicate hour information and the less significant two digit positions are allotted to indicate minute information.

A digital display type electronic watch capable of displaying the current time and date information has also been proposed and put in practical use. A typical digital display type electronic watch adapted for displaying the current time and date information is structured such that extra digit display positions are provided for display of the current date information such as the month and the day of the week apart from the digit display positions for display of the current time information such as the hour, minute and second. Typically the current date information concerning the month and the day of the week is indicated by abbreviations of the alphabet characters comprising a combination of two or three alphabet characters. Such characters can be displayed through selective energization of an arrangement of a plurality of segments in each of the display digit positions provided apart from the digit display positions for displays of the current time information. Such an arrangement of segments may comprise a plurality of segments arranged in the form of cross-in-square or cross-and-diagonal-cross in square. Provision of such extra digit display positions only for display of the current date information concerning the month or the day of the week requires an increased display area, which degrades the space factor of the display of a small sized digital display type electronic watch, such as a digital display type electronic wrist watch. Thus it is desired that an improved digital display type electronic watch is provided which is capable of displaying the current time information such as the hour, minute and the like in numeral characters and the current date information concerning at least the day of the week and preferably the month as well in alphabet characters in a small display area without reducing the size of the characters for displaying such information concerning the current date as well as the current time. The present invention achieves that purpose.

SUMMARY OF THE INVENTION

Briefly described, the present invention comprises a digital display type electronic watch, comprising: means for generating a time reference signal; means responsive to said time reference signal for generating a horological information signal representative of the current time information, said horological information signal generating means comprising first horological information signal generating means for generating a first horological information signal representative of the current time and second horological information signal generating means for generating a second horological information signal representative of the current date; means responsive to said horological information signal generating means for displaying said current time information, said display means comprising a plurality of digit display positions, each capable of displaying numeral characters means for selecting a display operation mode of said electronic watch, said display operation mode comprising a current time display operation mode and a current date display operation mode, and selective response means responsive to said display operation mode selecting means for selectively making said display means to said first horological information signal generating means in said current time display operation mode and for selectively making said display means to said second horological information signal generating means in said current date display operation mode, characterized in that the said second horological information signal is adapted to be representative of the current date in terms of the day of the week by the use of a language characters, typically comprising an abbreviation of at least two alphabet characters standing for the day of the week, said second horological information signal generating means comprises means for decoding said second horological information signal into an alphabet character signal representative of the day of the week in terms of the alphabet characters, at least a portion of said plurality of digit display positions of said display means is adapted to be capable of selectively displaying numeral and alphabet characters at such each digit position. The current time information such as the hour, minute, and second, and the current date information concerning at least the day of the week are selectively displayed by the display means sequentially in response to manual operation of the display operation mode selecting means by the use of the common display digit positions of the display means. As a result, both the current time information such as the hour, minute, and second and the current date information concerning at least the day of the week can be displayed using a relatively small display area, without degrading the quality of display of the information. Thus, a small sized digital display type electronic watch can be provided that is capable of displaying the current time information by the use of the numeral character and the current date information concerning the day of the week by the use of the alphabet characters in a relatively small display area.

Preferably, the said alphabet characters for displaying the current date information concerning the day of the week comprise alphabet characters of at least two kinds of European languages, and the said decoding means is adapted to decode the second horological information signal to at least two kinds of alphabet character signals each representative of the day of the week in terms of said alphabet characters of said at least two kinds of European languages. The display operation mode selecting means is also adapted such that the current date display operation mode comprises a first language current date display operation mode and a second language current date display operation mode, and the selective response means is also adapted such that the same is responsive to said display operation mode selecting means for selectively making said display means to one of said at least two kinds of alphabet character signals representative of the day of the week. As a result, preselection of any desired one of said at least two kinds of alphabet characters of European languages makes the electronic watch adapted for a display of the current date information concerning the day of the week in a desired language. Thus, a digital display type electronic watch of versatility is provided.

Therefore, a principal object of the present invention is to provide an improved digital display type electronic watch that is capable of displaying the current time information by the use of the numeral characters and the current date information concerning at least the day of the week by the use of an alphabet character.

Another object of the present invention is to provide an improved digital display type electronic watch that is capable of displaying the current time information by the use of the numeral characters and the current date information concerning at least the day of the week by the use of an alphabet character using a relatively small display area without degrading the quality of display of the information.

A further object of the present invention is to provide an improved digital display type electronic watch that is capable of displaying the current time information by the use of the numeral characters and the current date information concerning at least the day of the week by the use of an alphabet characters at the common display digit positions of the display means.

Still a further object of the present invention is to provide an improved digital display type electronic watch capable of displaying the current date information concerning the day of the week using language characters in addition to the current time information using numeral characters, wherein preselection of a display operation mode allows for display of the current date information concerning the day of the week by the use of language characters of a desired one kind of languages out of a plurality of different kinds of languages.

These objects and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
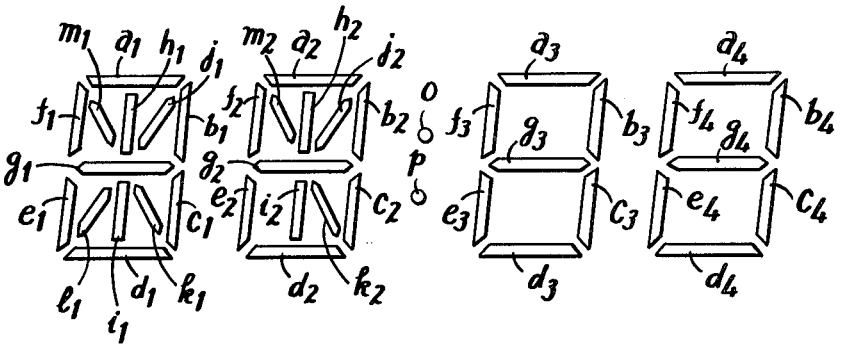
FIG. 1 shows a front view of the display of one embodiment of the inventive digit display type electronic watch.

FIG. 1 shows a front view of the display of one embodiment of the inventive digit display type electronic watch. Referring to FIG. 1, it is seen that the display of the embodiment shown comprises four digit display positions. According to the present invention, at least two digit display positions are adapted to be capable of selectively displaying the alphanumeric characters, while the remaining digit display positions are adapted to be capable of selectively displaying the numeral characters. In the embodiment shown, the most significant two digit display positions are adapted to be capable of selectively displaying the alphanumeric characters, while the least significant two digit display positions are adapted to be capable of selectively displaying the numeral characters. As seen from the embodiment shown, each of the digit display positions comprises an arrangement of a plurality of segments. It is well known by those skilled in the art that an arrangement of a plurality of segments is utilized in each of the digit display positions such that alphanumeric characters or numeral characters are selectively displayed in terms of an arrangement of the segments selected by a segment selecting signal decoded from an alphanumeric character signal or numeral character signal.

Referring to FIG. 1, the most significant digit display position comprises an arrangement of a plurality of segments arranged in the form of cross-and-diagonal-cross in square. More specifically, the arrangement of the segments comprises an upper horizontal segment a1, an upper right vertical segment b1, a lower right vertical segment c1, a lower horizontal segment d1, a lower left vertical segment el, an upper left vertical segment f1, a middle horizontal segment g1, an upper middle vertical segment h1, a lower middle vertical segment i1, an upper right diagonal segment j1 (extending from the upper right corner to the center of the arrangement), a lower right diagonal segment k1 (extending from the lower right corner to the center of the arrangement), a lower left diagonal segment l1 (extending from the lower left corner to the center of the arrangement), and an upper left diagonal segment m1 (extending from the upper left corner to the center of the arrangement). The segments a1, b1, c1, d1, e1 and f1 form a square shape, the segments g1, h1 and i1 form a cross, and the segments j1, k1, l1 and m1 form a diagonal cross. As a result, the arrangement of the segments constitute the form of cross-and-diagonal-cross in square. The second digit display position comprises a similar arrangement of the segments a2, b2, c2, d2, e2, f2, g2, h2, i2, j2, k2, and m2, in which similar reference character have been adopted such that the same alphabet characters are used to denote the corresponding segments while the subscript "1" is employed in the first significant digit display position and the subscript "2" is employed in the second digit display position. Only one difference between the first and second digit display positions in structure is that the lower left diagonal segment l2 corresponding to the segment l1 has been ommitted.

The third and fourth digit display positions each comprise a simplified arrangement of the segments a3, b3, c3, d3, e3, f3 and g3 and the same arrangement of the segments a4, b4, c4, d4, e4, f4 and g4, respectively. Each of the third and fourth digit display positions comprises a typical arrangement of the segments in the form of the numeral character "8" or in the form of minus -in-square, which is also well known to those skilled in the art. The display of the embodiment shown further comprises an arrangement of the segments O and P so as to constitute a colon mark between the most significant two digit display positions and the least significant two digit display positions.

Figure 2:
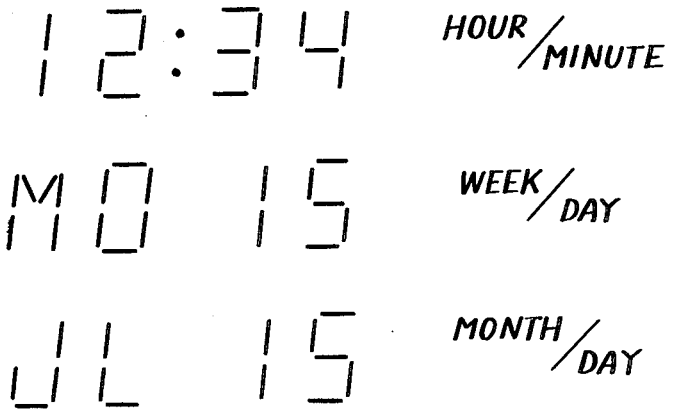
FIG. 2 shows examples of indication by the display of the embodiment shown.

According to the embodiment shown, the most significant two digit display positions are allotted to selectively display the current time information concerning the hour, the current date information concerning the day of the week and the current date information concerning the month and the least significant two digit display positions are allotted to selectively display the current time information concerning the minute and the current date information concerning the day of the month. In order to make it possible to display these various pieces of information using a limited number of digit display positions, the embodiment shown is structured to make sequential display of these pieces of information in response to a display operation mode signal generated by a display operation mode selector, as to be more fully described subsequently. The embodiment shown is structured such that the display operation mode comprises a current time display operation mode for displaying the current time in terms of the hour and minute, a first current date display operation mode for displaying the current date in terms of the day of the week and the day of the month, and a second current date display operation mode for displaying the current date in terms of the month and the day of the month. FIG. 2 shows examples of indication by the display of the embodiment shown, wherein the top row shows an example of indication of the current time "12:34" in the current time display operation mode, the middle row shows an example of indication of the current date "MO 15" in the first current date display operation mode, and the bottom row shows an example of indication of the current date "JL 15" in the second current date display operation mode. By way of a modification, the first current date display operation mode may be achieved such that the most significant two digit display positions are allotted to indicate the current date information in terms of the day of the week and the least significant two digit display positions are allotted to indicate the current time information in terms of the second.

From the foregoing description it is appreciated that according to the present invention a portion of a plurality of digit display positions is structured to be capable of selectively displaying the alphanumeric characters and in the current date display operation mode the said alphanumeric displaying portion is controlled to display the day of the week, and preferably further the month, by the use of the language characters such as alphabet characters, while in the current time display operation mode all of the said plurality of digit display positions are controlled to indicate the current time information by the use of the numeral characters. Selection of the segments in response to a segment selecting signal to indicate a desired alphabet character or numeral character is well known to those skilled in the art but will be described in more detail subsequently.

According to a preferred embodiment of the present invention, the embodiment is further structured such that the current date information concerning the day of the week, and the month as well if desired, is indicated by the use of a language character of a selected one kind of language out of at least two kinds of languages, such as English and French. If desired, by way of a further preferred embodiment of the invention, the embodiment may be structured such that the current date information concerning the month is alternatively indicated by the use of the numeral characters. Such a selective indication of the day of the week and the month using the language character of a selected kind of language out of two or more kinds of the languages will be described in more detail in the following.

According to the embodiment shown, the English language and the French language are employed by way of the alternative languages. Then an abbreviation of two alphabet characters is adopted to stand for each of the days of the week and each of the months for each of the English and French languages.

Table I

| | English Language | |
|---|---|---|
| Day of the Week | English Representation | Abbreviation |
| Sunday | Sunday | SU |
| Monday | Monday | MO |
| Tuesday | Tuesday | TU |
| Wednesday | Wednesday | WE |
| Thursday | Thursday | TH |
| Friday | Friday | FR |
| Saturday | Saturday | SA |

| Month | English Representation | Abbreviation | Month | English Representation | Abbreviation |
|---|---|---|---|---|---|
| January | January | JA | July | July | JL |
| February | February | FE | August | August | AU |
| March | March | MA | September | September | SE |
| April | April | AP | October | October | OC |
| May | May | MY | November | November | NO |
| June | June | JU | December | December | DE |

Table II

| Day of the Week | French Language: French Representation | Abbreviation |
|---|---|---|
| Sunday | Dimanche | DM |
| Monday | Lundi | LU |
| Tuesday | Mardi | MA |
| Wednesday | Mercredi | ME |
| Thursday | Jeudi | JE |
| Friday | Vendredi | VE |
| Saturday | Samedi | SA |

| Month | French Representation | Abbreviation | Month | French Representation | Abbreviation |
|---|---|---|---|---|---|
| January | Janvier | JA | July | Juillet | JI |
| February | Fevrier | FE | August | Aout | AO |
| March | Mars | MA | September | Septembre | SE |
| April | Avril | AV | October | Octobre | OC |
| May | Mai | MI | November | Novembre | NO |
| June | Juin | JU | December | Decembre | DE |

Table 1 shows a list of such abbreviations standing for the days of the week and the months in the English language and Table 2 shows a list of such abbreviations standing for the days of the week and months in the French language.

Figures 3, 7:
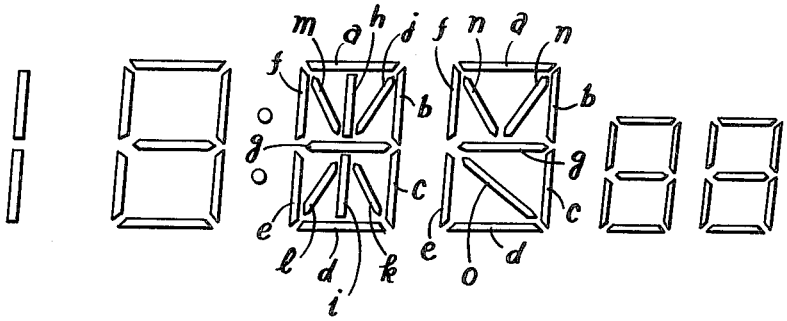
FIG. 3 shows an actual visual indication of the months both in the English and French languages.
FIG. 7 shows a front view of the display of another embodiment of the inventive digit display type electronic watch.
Figure 4:
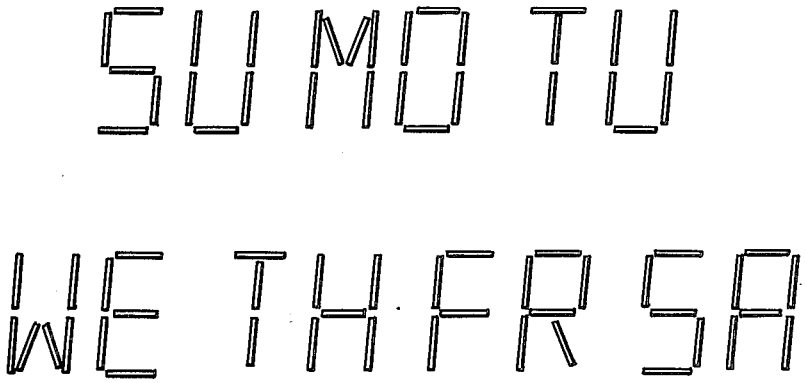
FIG. 4 shows an actual visual indication of the days of the week both in the English and French languages.
Figure 4:
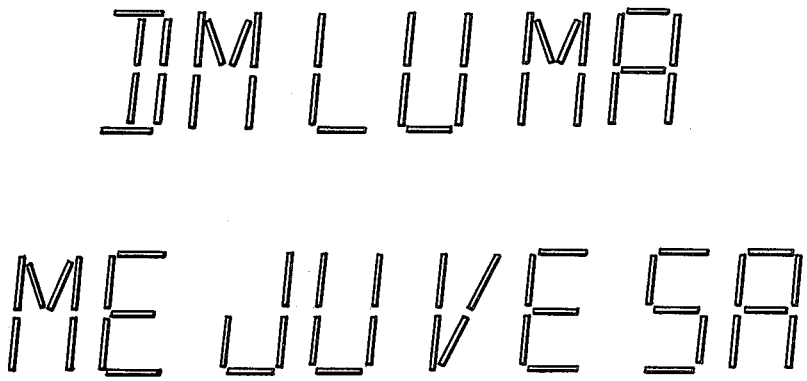

FIG. 4 shows an actual visual indication of the days of the week both in the English and French langauges using the arrangements of the segments shown in FIG. 1 and in accordance with the convention of Tables 1 and 2 and FIG. 3 shows an actual visual indication of the months both in the English and French languages using the arrangement of the segments shown in FIG. 1 and in accordance with the convention of Tables 1 and 2.

Figure 5:
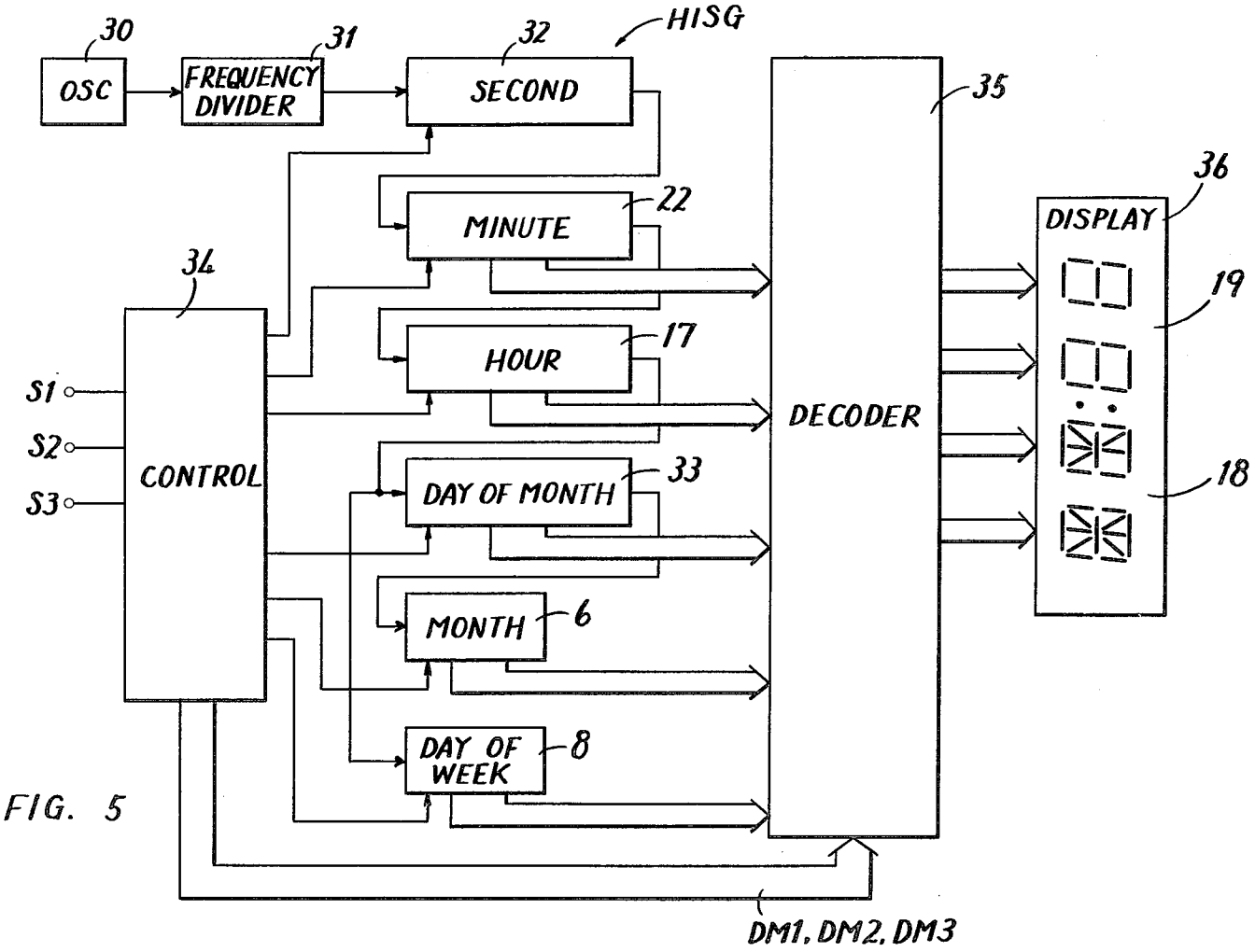
FIG. 5 shows a block diagram of one embodiment of the inventive digital display type electronic watch.

FIG. 5 shows a block diagram of one embodiment of the inventive digital display type electronic watch adapted for driving the FIG. 1 display. Referring to FIG. 5, the electronic watch shown basically comprises a time reference signal generator 30 typically comprising an oscillator adapted to be controlled by a crystal resonator, a frequency divider 31 coupled to the time reference signal generator 30 for frequency dividing the output from the generator 30, a horological information signal generator HISG coupled to the frequency divider 31 for generating a horological information signal representative of the current time information concerning the current time in terms of the hour, minute and second and representative of the current date in terms of the month, the day of the week, and the day of the month, a decoder 35 for decoding the horological information signal representative of the current time and date information generated by the horological information signal generator HISG into a segment selection signal for each digit display position of a display 36 as shown in FIG. 1, and a control circuit 34 responsive to external switches S1, S2 and S3 for controlling the operation of the horological information signal generator HISG and the operation of the decoder 35. The horological information signal generator HISG comprises a second counter 32 coupled to the output of the frequency divider 31 for counting the output of the frequency divider 31 for providing a BCD coded output representative of the current time information in terms of the second, a minute counter 22 coupled to the second counter 32 for counting the output of the second counter 32 for providing a BCD coded output representative of the current time information in terms of the minute, an hour counter 17 coupled to the output of the minute counter 22 for counting the output of the minute counter 22 for providing a BCD coded output representative of the current time information in terms of the hour, a day counter coupled to the output of the hour counter 17 for counting the output of the hour counter 17 for providing a BCD code output representative of the current date information in terms of the day of the month, a month counter coupled to the output of the day counter 33 for counting the output of the day counter 33 for providing a BCD code output representative of the current date information in terms of the month, and a week counter 8 coupled to the output of the hour counter 17 for counting the output of the hour counter 17 for providing a BCD code output represenative of the current date information in terms of the day of the week.

The decoder 35 comprises a minute decoder for decoding the BCD coded output of the minute counter 22 into a segment selection signal for the least two significant digit display positions 18, an hour decoder for decoding the BCD coded output of the hour counter 17 into a segment selection signal for the most significant two digit display positions 18, a day-of-the-month decoder for decoding the BCD coded output of the day counter 33 into a segment selection signal for the least two significant digit display positions 19, a month decoder for decoding the BCD coded output of the month counter 6 into a segment selection signal for the most two significant digit display positions 18, and a day-of-the-week decoder for decoding the BCD coded output of the week counter 8 into a segment selection signal for the most significant two digit display positions 18.

The switch S2 is allotted to display operation mode control. Hence the control 34 is structured to be responsive to the input through the switch S2 to generate a current time display operation mode signal DM1 for display of the current time, a first current date display operation mode signal DM2 for display of the day of the week and the day of the month, and a second current date display operation mode signal DM3 for display of the month and the day of the month. The various decoders in the decoder 35 are adapted to be responsive to the display operation mode signals DM1, DM2 and DM3 to be enabled to send the corresponding segment selection signals to the corresponding digit display positions in the display 36, as to be more fully described subsequently. The control 34 is also adapted to be responsive to the output of the switch S3 to make quick advancement of various counters of the horological information signal generator HISG for the purpose of calibration of the current time information and the current date information to be displayed by the display 36.

Figure 6:
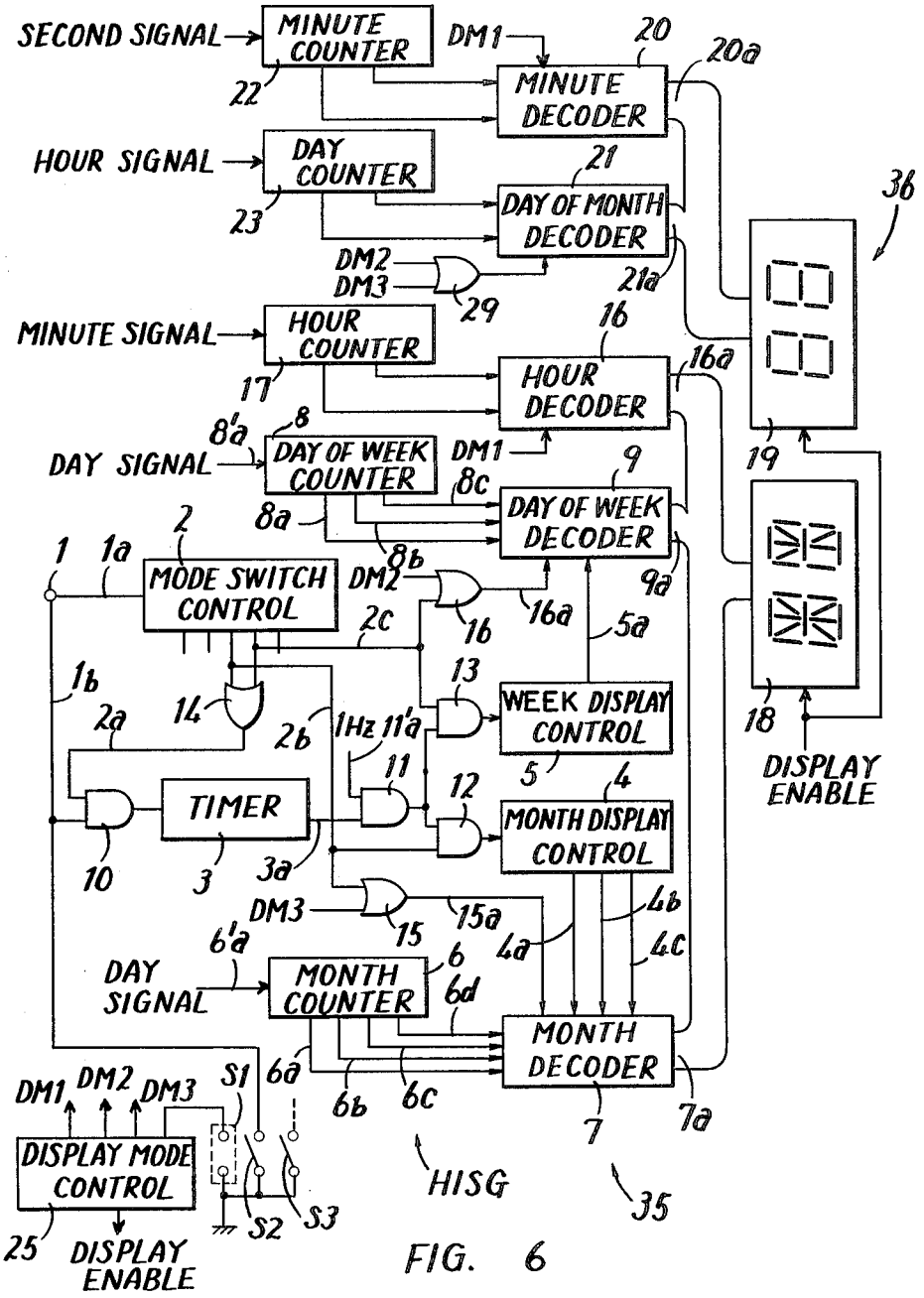
FIG. 6 shows a block diagram of a major portion of the inventive digital display type electronic watch.

FIG. 6 shows a block diagram of a major portion of the inventive digital display type electronic watch, which has been adapted such that the above described three display operation modes can be selected while indication of the months can be selected among the numeral characters and the alphabet characters of the abbreviations from the English and French languages and indication of the day of the week can be selected between the alphabet characters of the abbreviations from the English and French languages.

Referring to FIG. 6, the display 36 is shown comprising the most significant two digit display positions 18 and the least significant two digit positions 19. The most and least significant two digit positions 18 and 19 are structured to be enabled responsive to a display enable signal, as to be more fully described subsequently. The most significant two digit display positions 18 are connected from an hour decoder 16 through a signal line 16*a*, from a week decoder 9 through a signal line 9*a*, and a month decoder 7 through a signal line 7*a* in an OR fashion.

The hour decoder 16 is structured to decode the BCD coded output from the hour counter 17 into a segment selection signal for selecting the segments in the most significant two digit display positions 18 for indicating the current hour by the use of the numeral characters. The detailed structure of such hour decoder 16 is well known to those skilled in the art. The hour decoder 16 is also structured to be enabled responsive to a current time display operation mode signal DM1 which will be described in more detail subsequently.

The week decoder 9 is structured to decode the BCD coded output (8*a*, 8*b* and 8*c*) from the week counter 8 into a segment selection signal for displaying the current day of the week by the use of the alphabet characters of the above described abbreviations of the English or French language. To that end, typically the week decoder comprises first and second decoder circuits (not shown), the first being structured to decode the BCD coded output of the week counter 8 into a segment selection signal for displaying the current day of the week by the use of the alphabet characters of the above described abbreviations of the English language and the second being structured to decode the BCD coded output of the week counter 8 into a segment selection signal for displaying the current day of the week by the use of the alphabet characters of the above described abbreviations of the French language. The week decoder 9 is further connected to receive the output from an OR gate 16 through a signal line 16*a* and a week display control 5 through a signal line 5*a*. The week decoder 9 is structured to be enabled by the output from the OR gate 16. One input to the OR gate 16 is connected to receive a first current date display operation mode signal DM2. The above described week display control 5 may typically comprise a flip-flop and the high level output therefrom is allotted to enable the said first decoder circuit for decoding the BCD coded output into a segment selection signal for the English language and the low level output therefrom is allotted to enable the said second decoder for decoding the BCD coded output into a segment selection signal for the French language.

The month decoder 7 is structured to decode the BCD coded output (6*a*, 6*b*, 6*c* and 6*d*) into a segment selection signal for selecting the segments of the most significant two digit display positions 18 for displaying the current month by the use of the numeral characters or the alphabet characters of the above described abbreviations of the English or French language. To that end, the month decoder 7 may typically comprise three decoder circuits, the first being structured to decode the BCD coded output from the month counter 6 into a segment selection signal for indicating the current month by the use of the numeral characters, the second being structured to decode the BCD coded output of the month counter 6 into a segment selection signal for displaying the current month by the use of the alphabet characters of the above described abbreviations of the English language and the third being structured to decode the BCD coded output from the month counter 6 into a segment selection signal for displaying the current month by the use of the alphabet characters of the above described abbreviations of the French language. The month decoder 7 is operatively coupled to a month display control 4 to receive a numeral character display control signal 4*a*, an English language character display control signal 4*b*, or a French language character display control signal 4*c*. The first decoder circuit for decoding the BCD coded output into a segment selection signal for displaying the current month by the use of the numeral characters is structured to be enabled by the numeral character display control signal 4*a*, the second decoder circuit for decoding the BCD coded output into a segment selection signal for displaying the current month by the use of the English language characters is structured to be enabled by the English language character display control signal 4*b*, and the third decoder circuit for decoding the BCD coded output into a segment selection signal for displaying the current month by the use of the French language characters is structured to be enabled by the French language character display control signal 4*c*. The month decoder 7 is further structured to be enabled by the output from an OR gate 15 obtained through a signal line 15*a*. One input to the OR gate 15 is connected to receive a second current time display operation mode signal DM3. The month display control 4 may typically comprise a shift register or a counter which is responsive to the output from an AND gate 12 to provide the above described display control signal 4*a*, 4*b* or 4*c*.

The least significant two digit display positions 19 are connected from a minute decoder 20 through a signal line 20*a* and from a day-of-the-month decoder 21 through a signal line 21*a* in an OR fashion. The minute decoder 20 is structured to decode the BCD coded output from the minute counter 22 into a segment selection signal for selecting the segments in the least significant two digit display positions 19 for displaying the current time information in terms of the minute by the use of the numeral characters. The minute decoder 20 is also structured to be enabled in response to the current time display operation mode signal DM1. The day-of-the-month decoder 21 is structured to decode the BCD coded output from the day counter 23 into a segment selection signal for selecting the segments of the least significant two digit display positions 19 for displaying the current time information in terms of the day of the month by the use of the numeral characters. The day-of-the-month decoder 21 is also structured to be enabled in response to the output from an OR gate 29 which is connected to receive the first current date display operation mode signal DM2 and the second current date display operation mode signal DM3.

Since various counters 17, 8, 6, 22 and 23 were described in detail with reference to FIG. 5, it is not believed necessary to describe these here in more detail.

The other input to the OR gate 16 is connected through a signal line 2*c* to one output of a mode switch control 2. Similarly, the other output of the OR gate 15 is connected through a signal line 2*b* to another output of the mode switch control 2. One input of the AND gate 13 is also connected through the signal line 2*c* to the same output of the mode switch control 2 that is connected to the other input of the OR gate 16. Similarly, one input to the AND gate 12 is also connected through the signal line 2*b* to the same output of the mode switch control 2 that is connected to the other input of the OR gate 15. The other input of the AND gate 13 and the other input of the AND gate 12 are connected to the output of an AND gate 11. One input to the AND gate 11 is connected through a signal line 11*a* to receive an input signal of 1 Hz. The other input of the AND gate 11 is connected through a signal line 3*a* to the output of a timer circuit 3. The input of the timer circuit 3 is connected to the output of an AND gate 10 such that the timer is released from the reset state in response to the output of the AND gate 10. One input of the AND gate 10 is connected through a signal line 2*a* to the output of an OR gage 14. The inputs of the OR gate 14 are connected to the said one and other output terminals of the mode switch control 2 that are connected to the gates 16, 13, 12 and 15. The input of the mode switch control 2 and the other input of the AND gate 10 are connected through a signal line 1*a* and a signal line 1*b*, respectively, and through a common terminal 1 to the switch S2.

The switch S1 is connected to a display mode control 25. The display mode control 25 is structured to be responsive to the output of the switch S1 to generate the above described display operation mode signals DM1, DM2, and DM3 and a display enabling signal.

Now the operation of the FIG. 6 diagram will be described in the following. Each time the correction mode changing switch S2 is depressed, a switch signal is applied through the terminal 1 and the signal line 1*a* to the mode switch control 2. Typically the mode switch control 2 comprises a ring counter. Therefore, only one of a plurality of output terminals of the mode switch control 2 assumes the high level and shifts one by one each time the switch signal is received. In the embodiment shown, the third output terminal from the left is allotted to the month correction mode and the fourth output terminal from the left is allotted to the week correction mode. Thus, the month correction mode output or the week correction mode output is applied through the OR gate 14 and the signal line 2*a* to one input of the AND gate 10. As a result, the switch signal received from the correction mode switch S2 through the terminal 1 and the signal line 1*b* is applied through the AND gate 10, if and when the above described month correction signal or the week correction mode signal is obtained from the mode switch control 2. The timer 3 is structured to be normally reset and to be released from the resetting state in response to the input thereto. Therefore, after the lapse of a predetermined time period, say 1.5 seconds or 2 seconds, a timer signal is applied through the signal line 3*a* to the input of the AND gate 11. As a result, a train of pulses of the frequency of 1 Hz is allowed to pass through the AND gate 11 to the input to the AND gates 13 and 12. The AND gate 12 is also connected to receive the above described month correction mode signal through the signal line 2*b* and the AND gate 13 is also connected to receive the above described week correction mode signal through the signal line 2*c*. Therefore, the said train of pulses of 1 Hz is allowed to pass through the AND gate 13 or 12, depending upon the correction mode signal obtainable from the mode switch control 2.

As described previously, the week display control 5 comprises a flip-flop. Hence, the week display control 5 changes the storing state of the flip-flop alternately in response to the output from the AND gate 13. The high level output from the week display control 5 is applied to the week decoder 9 as a selection signal of the English language and the low level output from the week display control 5 is applied to the week decoder 9 as a selection signal of the French language. The month display control 4 is controlled in response to the output from the AND gate 12 such that the high level signal is in succession obtained from the output terminals 4*a*, 4*b* and 4*c* repeatedly in response to each pulse of the above described train of pulses. The output from the terminal 4*a* is applied to the month decoder 7 as a selection signal of the numeral characters, the output from the terminal 4*b* is applied to the month decoder 7 as a selection signal of the English language characters, and the output from the terminal 4*c* is applied to the month decoder 7 as a selection signal of the French language characters.

When the correction mode changing switch S2 is released from depression, the timer 3 is reset and the pulse signal applied to the AND gate 11 is interrupted from passing therethrough, whereby the display control 5 or 4, as selected by the output from the mode switch control 2, is brought to a stop to keep the storing state of the control 5 or 4 at that time.

If and when the display operation mode control switch S1 is depressed for the first time, the display operation mode control 25 is controlled to provide a display enabling signal for a predetermined time period of say 1.5 seconds. As a result, the display 36 is enabled by the display enabling signal to display the information by the use of the numeral and/or alphabet characters achieved by the selected segments of the display 36 for the above described predetermined time period. At the same time the display operation mode control 25 is controlled to generate the current time display operation mode signal DM1 for the said predetermined time period. As a result, the above described current time display operation mode is attained and the hour decoder 16 and the minute decoder 20 are enabled. As a result, the current time information is displayed by the display 36 such that the current hour information is displayed by the most significant two digit display positions 18 and the current minute information is displayed by the least significant two digit display positions 19. If and when the display operation mode control switch S1 is depressed again during the above described current time display operation mode of the said predetermined time period, then the display operation mode control 25 is controlled to generate the first current date display operation mode signal DM2 for a predetermined time period of say 1.5 seconds. As a result the week decoder 9 and the month decoder 21 are enabled in response to the first current date display operation mode signal DM2. Therefore, during the first current date display operation mode, the date information is displayed by the display 36 such that the day of the week is displayed by the most significant two digit positions 18 by the use of the alphabet characters of the abbreviation of the language as selected by the week display control 5 and the current day of the month is displayed by the least significant two digit display positions 19 by the use of the numeral characters. If and when the display operation mode control switch S1 is kept depressed even after the above described predetermined time period, the display operation mode control 25 is controlled to generate the second current date display operation mode signal DM3 for a predetermined time period of say 1.5 second. As a result the month decoder 7 and the day-of-the-month decoder 21 are enabled. Thus, in this second current date display operation mode, the current month is displayed by the most significant two digit display positions 18 by the use of the numeral characters, or the alphabet characters of the abbreviation of the language as selected by the month display control 4, and the current day of the month is indicated by the least significant two digit display positions 19 by the use of the numeral characters.

Each time the correction mode changing switch S2 is depressed, the correction mode is changed. More specifically, each time the switch S2 is depressed, the correction mode is changed from the month, the day of the month, the day of the week, the hour, and the minute in the order as described. If and when the switch S2 is kept depressed for more than a predetermined time period in the above described month correction mode or the day of the week correction mode, the above described train of pulses is kept applied through the AND gate 11 and the AND gate 13 or 12 as selected to the control 5 or 4 as selected. As a result, the storing state of the control 5 or 4 as selected changes in succession in response to the pulse signal of 1 Hz. As a result, in case of the week correction mode, the manner of indication of the current day of the week is changed in succession between the English and French languages, and in case of the month correction mode, the manner of indication of the current month information is changed in succession among the numeral characters, and the alphabet characters of the English and French languages. If and when the desired manner of indication of the week and the month is selected, as described above, another switch S3 is depressed to achieve the quick advancement for the purpose of calibration. More specifically, if and when the switch S3 is depressed while the manner of indication of the month has been selected to be the indication of the numeral characters, the quick advancement of the months from "1" through "12" is achieved. Assuming that the manner of indication of the month by the use of the English language, the quick advancement of the months from "JA" through "DE" is achieved. Similar quick advancement can be made with respect to the manner of indication of the day of the week. Since the scheme for quick advancement of the time and date information for the purpose of calibration is well known to those skilled in the art, it is not believed necessary to describe the same here in more detail.

The number of kinds of the languages for indicating the current date of the week or the current month depends on the scale of the week decoder 9 and the month decoder 7. The decoders 9 and 7 each may be implemented by a plurality of matrix decoders. Alternatively, however, the decoders 9 and 7 each may be implemented by a well known read only memory.

In case where the display 36 is implemented such that each digit display position may comprise an arrangement of a plurality of segments each comprising an arrangement of light emitting diodes, more power is consumed by the display 36. Thus, a less number of digit display positions is preferred in case of the display employing an arrangement of light emitting diodes. Thus, the embodiment of four digit display positions described in the foregoing may be advantageously employed in case of a display employing an arrangement of light emitting diodes. In case where a liquid crystal cell is used as a segment of the display, however, much less power is consumed by the display. Hence, the number of digit display positions in the display may be increased in case of the display employing an arrangement of liquid crystal cells as segments. In the following another embodiment of the present invention employing six digit display positions in a display will be described.

FIG. 7 shows a front view of the display of another embodiment of the inventive digit display type electronic watch comprising six digit display positions. The display of the embodiment shown is structured such that the middle significant two digit display positions are capable of selectively displaying the alphanumeric characters and the least significant two digit display positions are selected to be small in size. The segments of the colon mark are positioned between the most significant two digit display positions and the middle significant two digit display positions. The less significant digit position out of the middle significant two digit display positions comprises a modified arrangement of the segments a, b, c, d, e, f, g, n and o as shown, as compared with the arrangement of the segments discussed with reference to FIGS. 1 and 5, while the most significant digit position out of the middle significant two digit display positions comprises the same arrangement of the segments a, b, c, d, e, f, g, h, i, j, k, l, and m as that of the most significant digit display position in the FIGS. 1 and 5 embodiment.

Figure 8:
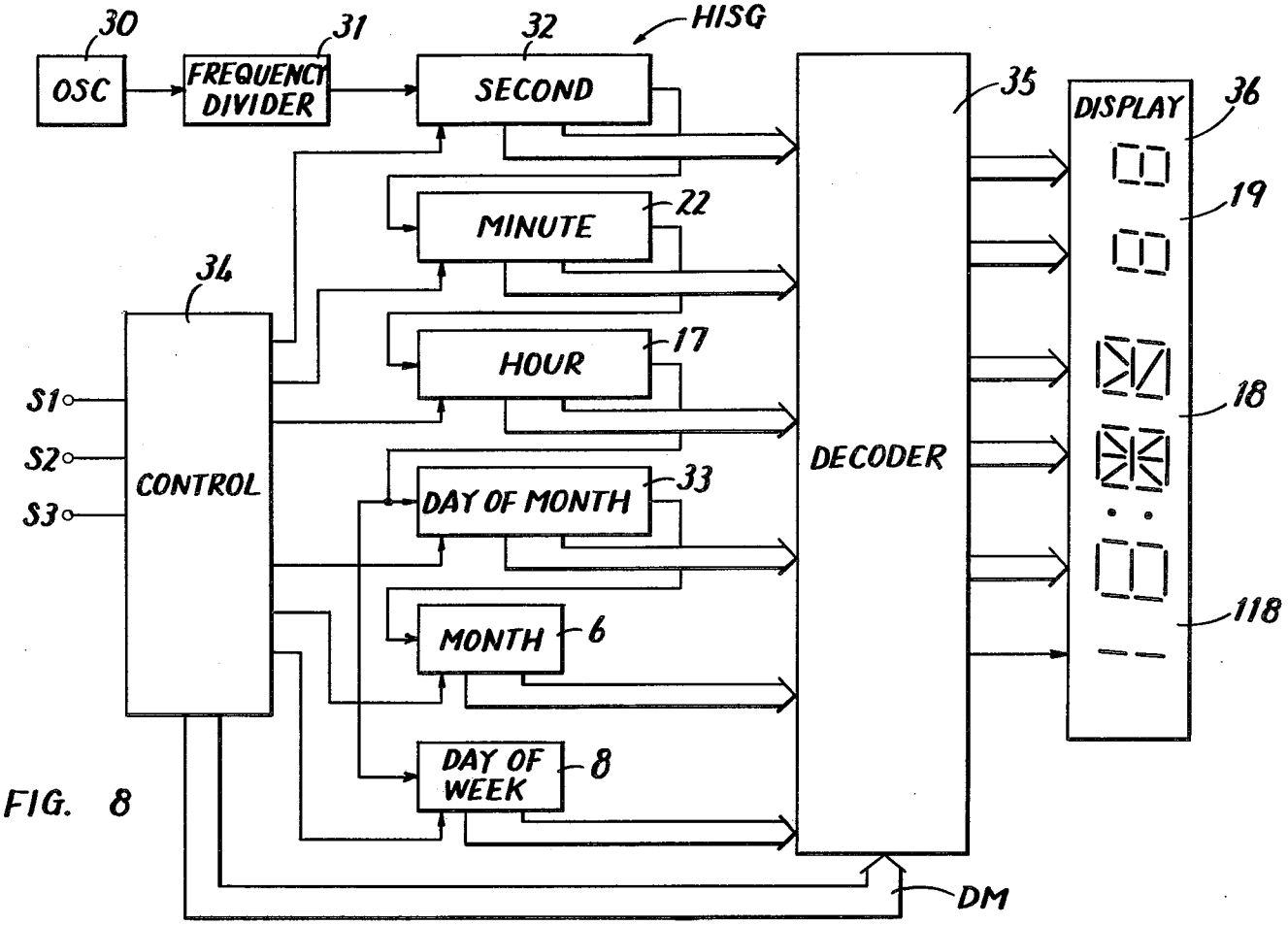
FIG. 8 is similar to the FIG. 5 illustration but shows a block diagram of another embodiment of the inventive digital display type electronic watch.

FIG. 8 is similar to the FIG. 5 illustration but shows a block diagram of the inventive digital display type electronic watch adapted for driving the FIG. 7 display. Since most portions in the FIG. 8 embodiment are similar to those in the FIG. 5 embodiment, like portions have been denoted by like reference characters. Thus, it is not believed necessary to describe in detail the structure of the FIG. 8 embodiment again. A major difference is that the most significant two digit display positions 118 are provided.

The FIG. 8 embodiment may be structured to achieve the successive display operation modes such that the current time display operation mode is allotted to display the current hour information, the current minute information and the current second information in the most, the middle and the least significant display digit positions 118, 18 and 19, respectively, the first current date display operation mode is allotted to display the current hour information, the current minute information and the current day of the month information in the most, the middle and the least significant digit display positions 118, 18 and 19, respectively and the second current date display operation mode is allotted to display the current month information, the current day of the week information and the current day of the month information in the most, the middle and the least significant digit display positions 118, 18 and 19, respectively. In such an example, the middle significant two digit display positions 18 are used to indicate the current minute information by the use of the numeral characters in the current time display operation mode and the first current date display operation mode and to indicate the current day of the week information by the use of the alphabet characters in the second current date display operation mode.

Alternatively, the FIG. 8 embodiment may be structured to achieve the successive display operation modes such that the current time display operation mode is allotted to display the current hour information, the current minute information and the current second information in the most, the middle, and the least significant display digit positions 118, 18 and 19, respectively, the first current date display operation mode is allotted to indicate the current month information and the current day of the month information in the middle and the least significant digit display positions 18 and 19, respectively, and the second current date display operation mode is allotted to indicate the current day of the week information and the current day of the month information in the middle and the least significant digit display positions 18 and 19, respectively. In such an example, the middle significant two digit display positions are used to indicate the current minute information in the current time display operation mode by the use of the numeral characters, to indicate the current month information in the first current date display operation mode by the use of the numeral characters as selected and to indicate the day of the week information in the second current date display operation mode by the use of the alphabet characters.

Figure 9:
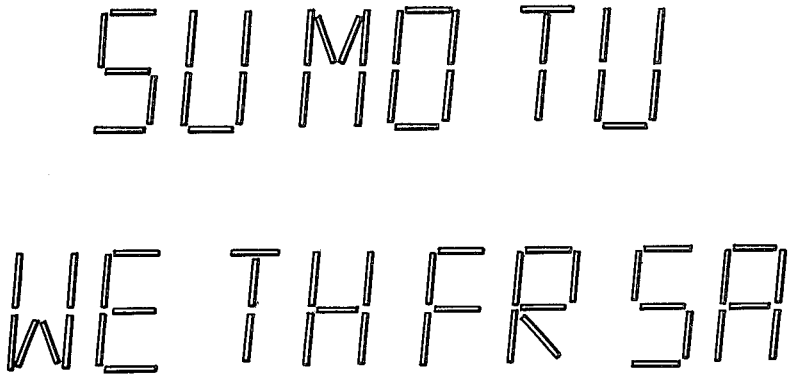
FIG. 9 shows an actual visual indication of the days of the week both in the English and French languages using the segment format of FIG. 7.
Figure 9:
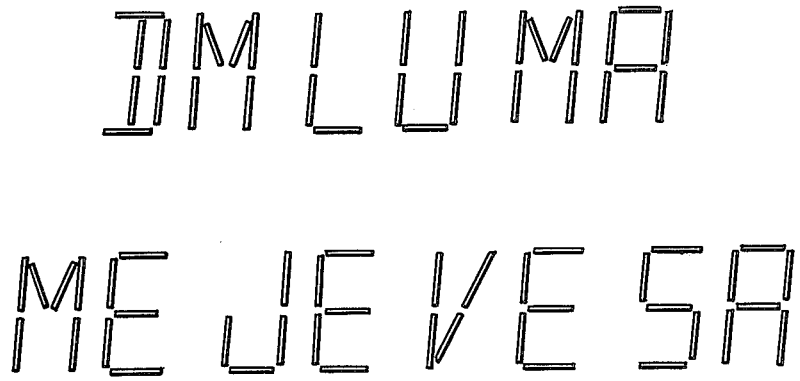

FIG. 9 shows an actual visual indication of the days of the week both in the English and French languages using the arrangement of the segments shown in FIG. 7.

Figure 10:
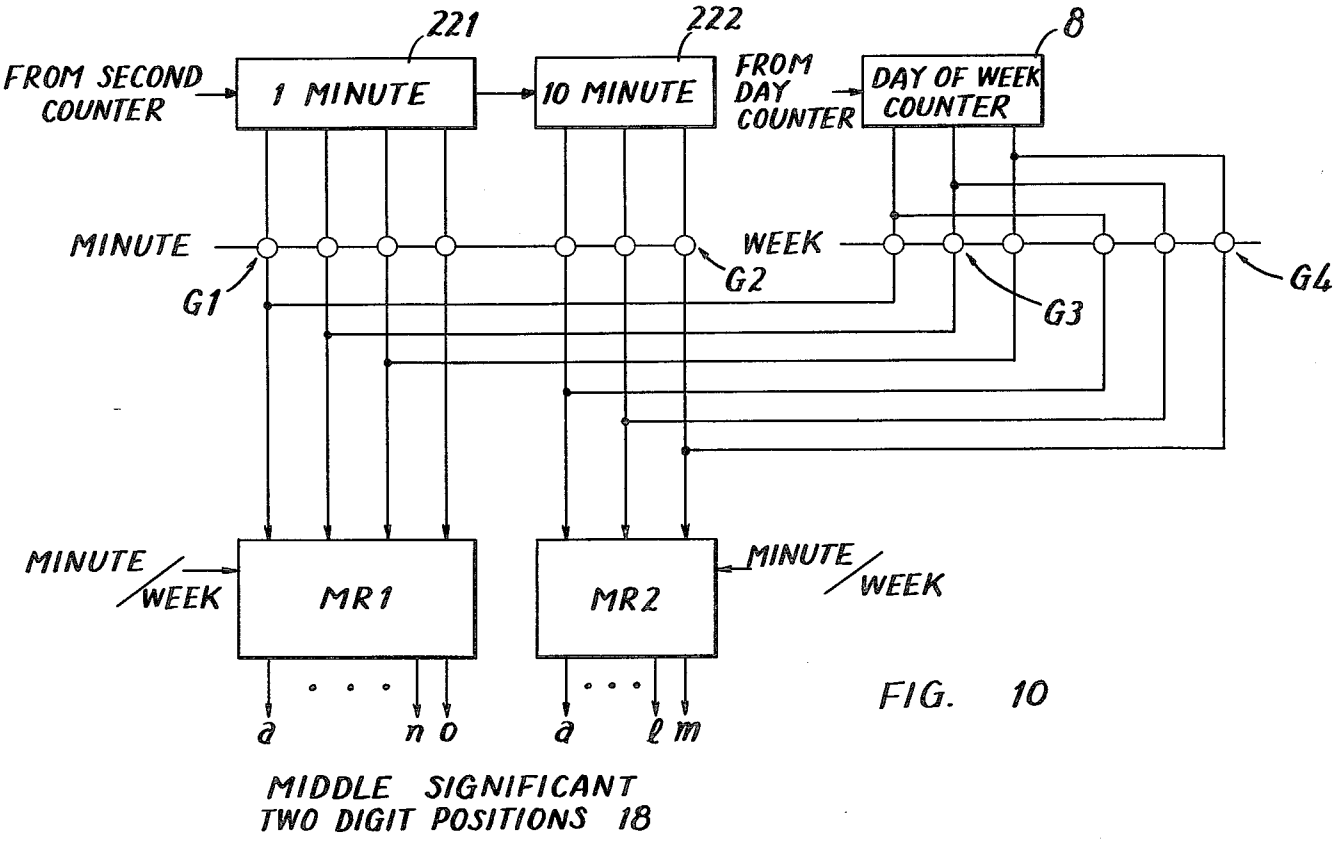
FIG. 10 is a block diagram showing in more detail a major portion of the FIG. 8 embodiment.

FIG. 10 is a block diagram showing in more detail a major portion of the FIG. 8 embodiment. Referring to FIG. 10, the minute counter 22 is shown comprising a one minute counter 221 and a ten minute counter 222. The BCD coded output of each of the counters 221 and 222 is applied in parallel through gates G1 and G2 to a corresponding one of read only memories MR1 and MR2. Similarly the BCD coded output of the week counter 8 is applied in parallel through gates G3 and G4 to the read only memories MR1 and MR2. The gates G1 and G2 are supplied with a minute display signal, and the gates G3 and G4 are supplied with a week display signal. The read only memories MR1 and MR2 are also supplied with a control signal representative of the minute and week. The read only memories MR1 and MR2 are structured such that the same is responsive to the minute/week control signal and the BCD coded output of the minute counter 22 or the week counter 8, as selected, to provide a segment selection signal of the current minute information by the use of the numeral characters or the current day of the week information by the use of the alphabet characters, as selected, by the middle significant two digit display positions 18. The read only memories MR1 and MR2 may be replaced by well known decoders comprising a matrix configuration.

Figure 11A:
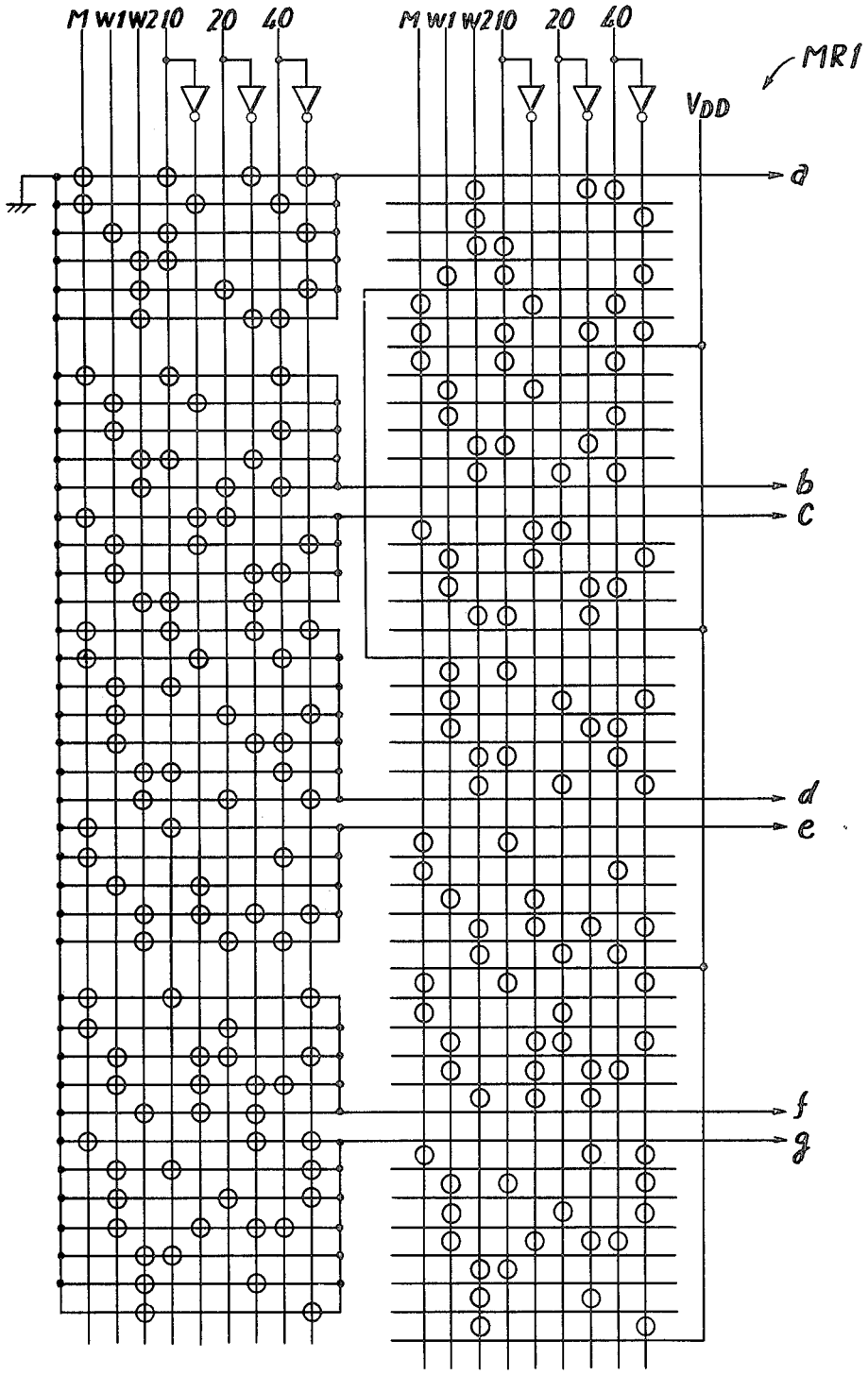
FIGS. 11A and 11B taken together are a schematic diagram of a matrix embodiment of one of the decoders of FIG. 10 of the present invention.
Figure 11B:
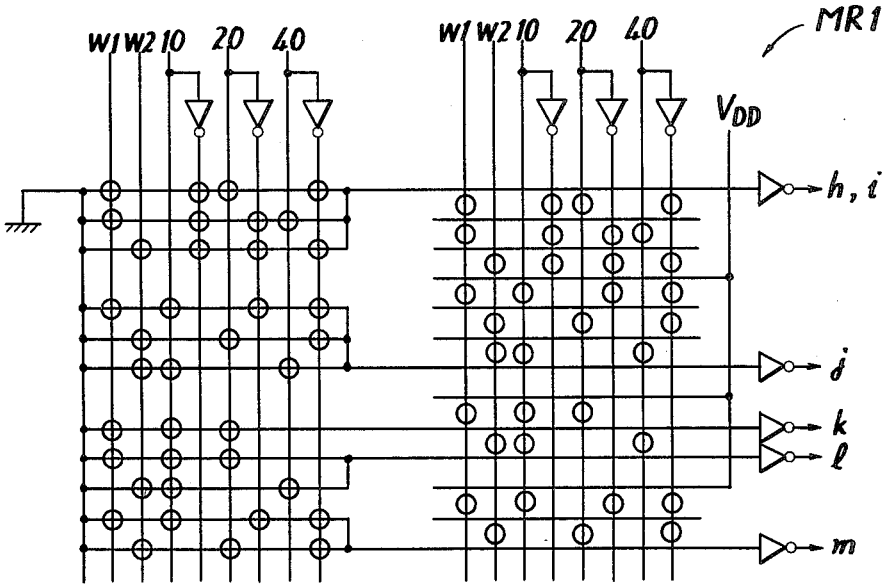
Figure 12:
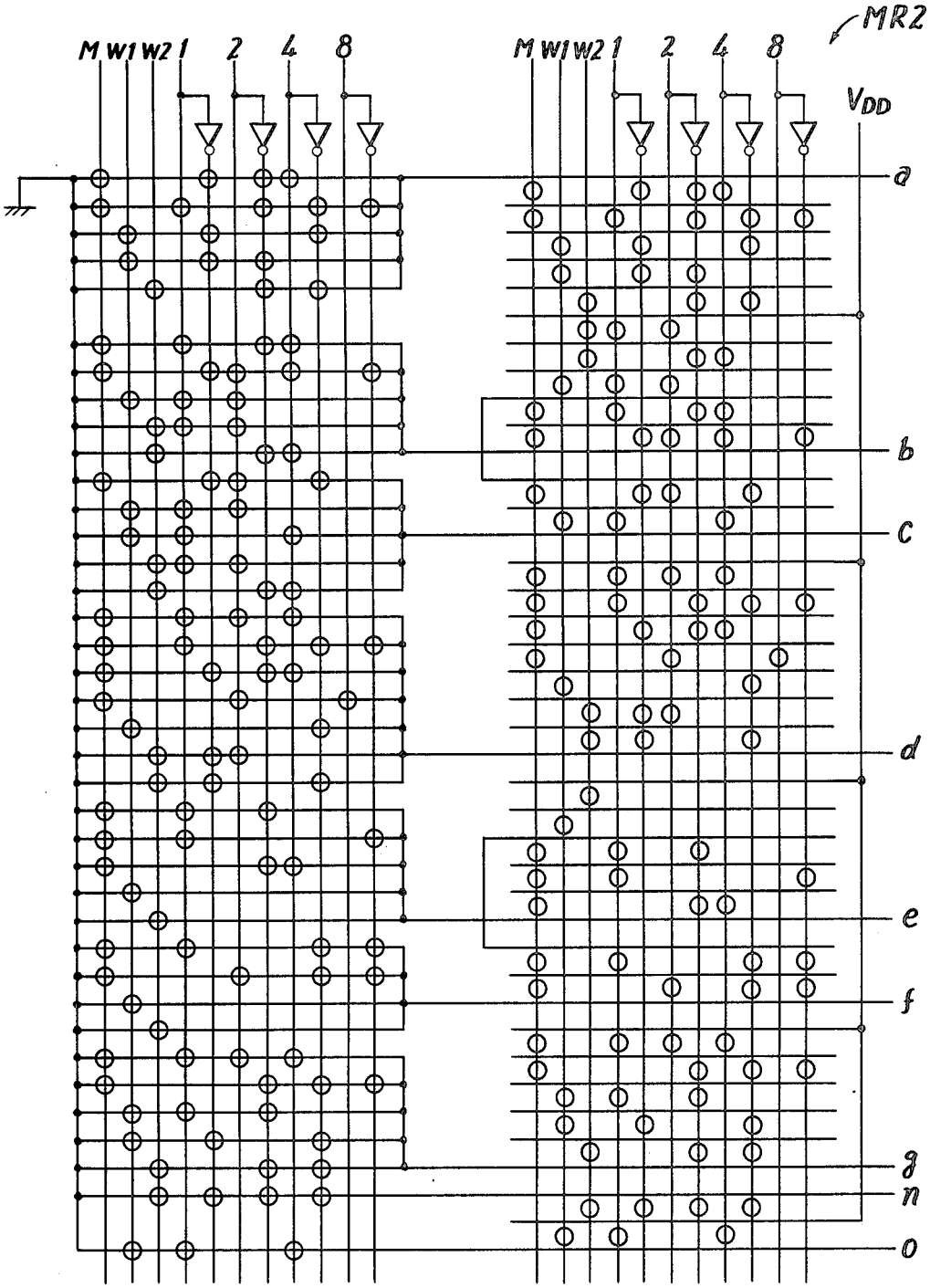
FIG. 12 is a schematic diagram of a matrix embodiment of another of the decoders of FIG. 10 of the present invention.

FIGS. 11 and 12 each show a schematic diagram of the decoders MR1 and MR2 comprising a matrix configuration. Referring to FIG. 11, which shows a matrix configuration of the decoder MR1, the decoder MR1 comprises two columns, a left and right columns, of matrixes, each of which is connected to receive at input terminals M, W1, and W2 the control signals for selecting the minute information display operation mode, the first week information display mode for displaying the week information in the English language, and the second week information display mode for displaying the week information in the French langauge, respectively, and at input terminals 10, 20 and 40 the 3-bit coded information from the ten minute counter 222 or the day of week counter 8, as selected, and further connected to provide at the output terminals a through m a segment selecting signal. The matrix configuration comprises column lines connected to the input terminals M, W1, W2, 10, 20 and 40 and row lines connected to the output terminals a through m, and decoding connections between the column and row lines represented by a circle mark, which typically implemented by a field effect device such that the input signals received at the input terminals are withdrawn in an OR fashion in the corresponding output terminal, whereby the input signals are decoded at the output terminals as a segment selection signal. In the embodiment shown, those field effect devices provided in the left column of the matrix are implemented by N channel field effect transistors, while those in the right column matrix are implemented by the P channel field effect transistors. Referring to FIG. 12, a similar diagram is shown for the decoder MR2. Since substantially the same structure has been adopted in the decoder MR2, it is not believed necessary to describe in detail the structure of the FIG. 12 matrix.

Although the present invention has been described and illustrated in detail, it is to be clearly understood that the same is by way of illustration and example only and is not to be taken by way of limitation, the spirit and scope of this invention being limited only by the terms of the appended claims.

What is claimed is:

1. A digital display type electronic time piece, comprising:

means for generating a time reference signal;

means responsive to said time reference signal for generating a horological information signal representative of the current time information, said horological information signal generating means comprising first horological information signal generating means for generating a first horological information signal representative of the current time and second horological information signal generating means for generating a second horological information signal representative of the current date, said first horological information signal comprising a numeral value information signal representative of the current time by the use of a combination of numeral characters, said second horological information signal comprising a week information signal representative of the current date in terms of the day of the week by the use of a language alphabet character;

means responsive to said horological information signal generating means for displaying said current time information, said display means comprising a plurality of digit display positions, each being adapted for selectively displaying numeral characters in response to said numeral value information signal, at least a portion of said plurality of said digit display positions being further adapted for selectively displaying a language character in response to said week information signal;

means for selecting a display operation mode of said electronic watch, said display operation mode comprising a current time display operation mode and a current date display operation mode;

selective response means responsive to said display operation mode selecting means for selectively making said display means responsive to said first horological information signal generating means in said current time display operation mode and for selectively making said display means responsive to said second horological information signal generating means in said current date display operation mode;

said numeral value information signal being applied in said current time display operation mode to said digit display positions of said display means for displaying the current time by the use of combination of numeral characters, said week information signal being applied in said current date display operation mode to said numeral/language character displaying portion of said plurality of digit display positions of said display means for displaying the current date in terms of the day of the week by the use of a language character;

said first horological information signal generating means comprising first means for decoding said first horological information signal to a numeral character signal representative of said current time in terms of said numeral characters;

said second horological information signal generating means comprising second means for decoding said second horological information signal to an alphabet character signal representative of said day of the week in terms of said alphabet character of said language;

said alphabet character for said week information signal comprising alphabet characters of at least two kinds of languages;

said second decoding means being adapted to be responsive to a language kind selecting signal to selectively decode said second horological information signal to one of at least two kinds of alphabet character signals representative of said day of the week in terms of said alphabet characters of one of said at least two kinds of languages;

input signaling means for providing an input signal to said time piece;

means operatively coupled to said input signaling means and responsive to said input signal for selectively providing to each of said first and second horological information signal generating means a correction mode selecting signal;

means operatively coupled to said input signaling means and said correction mode selecting signal providing means for determining when said input signal is of a duration longer than a predetermined time period for providing an input signal; and means responsive to the output of said duration determining means and said correction mode selecting signal providing means for providing said language kind selecting signal to said second decoding means in a cyclically recurrent mode to constrain the latter to provide said alphabet character signal in each of said kinds of languages.

2. A digital display type electronic time piece in accordance with claim 1, wherein said first horological information signal is adapted to be representative of the current time in terms of the hour and minute.

3. A digital display type electronic time piece in accordance with claim 2, wherein said first horological information signal is further adapted to be representative of the current time in terms of the second.

4. A digital display type electronic time piece in accordance with claim 1, wherein said language character for said week information signal comprises an abbreviation of at least two alphabet characters standing for the day of the week.

5. A digital display type electronic time piece in accordance with claim 1, wherein said numeral/language character display portion of said plurality of digit display positions of said display means is structured to be capable of selectively displaying alphanumeric characters at each digit display position.

6. A digital display type electronic time piece in accordance with claim 1, wherein each digit display position of said numeral/language character display portion of said plurality of digit display positions of said display means comprises an arrangement of a plurality of segments, and said first and second decoding means each comprise means responsive to said numeral and alphabet character signals for decoding the same to a segment selection signal representative of said current time and current date of the week in terms of an arrangement of the segments selected by said segment selection signal.

7. A digital display tube electronic time piece in accordance with claim 1, wherein said second horological information signal further comprises a month information signal representative of the current date in terms of the month by the use of a language character, said display operation mode comprising a further current date display operation mode, said month information signal being applied in said further current date display operation mode to said numeral/language character display portion of said plurality of digit display portions of said display means for displaying the current date in terms of the month by the use of a language character.

8. A digital display type electronic time piece in accordance with claim 7, wherein said language character for said month information signal comprises an alphabet character of a language.

9. A digital display type electronic time piece in accordance with claim 8, wherein said language character for said month information signal comprises an abbreviation of at least two alphabet characters standing for the month.

10. A digital display type electronic time piece in accordance with claim 1, wherein said second horological information signal comprises a day-of-the-month signal representative of the current date in terms of the day of the month by the use of a combination of numeral characters, said day-of-the-month signal being applied in said current date display operation mode to said digit display positions of said display means for displaying the current date in terms of the day of the month by the use of a combination of numeral characters.

11. A digital display type electronic time piece in accordance with claim 1, wherein said second horological information signal further comprises a month information signal representative of the current date in terms of the month by the use of a combination of numeral characters, said month information signal being applied in said current date display operation mode to said digit display positions of said display means for displaying the current date in terms of the month by the use of a combination of numeral characters.

12. A digital display type electronic time piece in accordance with claim 1, wherein said duration determining means comprises a timer.

13. A digital display type electronic time piece in accordance with claim 12, wherein said language kind selecting signal providing means comprises:

pulse source means for providing a cyclically recurrent signal; and means responsive to said cyclically recurrent pulse signal from said pulse source means and the output from said duration determining means for providing said language kind selecting signal to said decoder means in said cyclically recurrent mode.

14. A digital display type electronic time piece comprising:

digit display means comprising first, second, third, fourth, fifth and sixth digit display configurations arranged in a lineal pattern of substantially uniform adjacent spacing;

said first digit display configuration comprising the most significant digit of said display format and said sixth digit display configuration comprising the least significant digit thereof; and a punctuation display configuration intermediate said second and third digit display configurations in said format;

said first and second digit display configurations comprising numeric display configurations for selectively displaying hours and months;

said third and fourth digit display configurations comprising alphanumeric display configurations for selectively displaying minutes and identities of days of the week; and said fifth and sixth digit display configurations comprising numeric display configurations for selectively indicating seconds and daily dates and both said latter configurations being of lesser size than the preceding four digit display configurations;

time and signal generating means for generating encloded time and date signals;

said time signals being numeric in character and said date signals being alphanumeric in character;

decoder means responsive to said time and date signals for generating display control codes; and mode control means selectively enabling said decoder means and said time and date signal generating means into time and date display output modes;

said digit display means being driven by said decoder means in said time display output mode to display hours in said first and second digit display configurations, minutes in said third and fourth digit display configurations and seconds in said fifth and sixth digit display configurations; and said digit display means being driven by said decoder means in said date display output mode to display numerical month identification in said first and second digit display configurations, alpha character day of the week identification in said third and fourth digit display configurations and numerical daily dates of the month in said fifth and sixth digital display configurations; and said digit display type electronic time piece further including:

language selection signal generating means for generating cyclically recurrent language signals each representing a kind of language in which said alpha character day of the week identification is to be presented;

said decoder means being responsive to said cyclically recurrent language signals for enabling said third and fourth digital display configurations of said display means to display cyclically said day of the week identification in each of the particular selected languages represented by said language signals.

15. The digit display type electronic time piece of claim 14 wherein said alpha character day of the week identification comprises a two letter alphabetical abbreviation for each such day.

16. The digit display type electronic time piece of claim 14, wherein:

each said digit display configuration is defined by a plurality of display segments;

said first digit display configuration consists of a numeral one configuration; and said second, fifth and sxith digit display configurations each consists of a minus-in-square numeric configuration.

17. The digit display type electronic time piece of claim 16, wherein:

said alpha character day of the week identification comprises a two letter alphabetical abbreviation for each such day.

18. The digit display type electronic time piece of claim 16, wherein:

each said digit display configuration is defined by a plurality of display segments;

said third digit display configuration consists of a cross-and-diagonal-cross-in-square alphanumeric configuration of said display segments; and said fourth digit display configuration consists of a ten segment alphanumeric configuration.

19. The digit display type electronic time piece of claim 18, wherein:

said alpha character day of the week identification comprises a two letter abbreviation for each such day.

20. The digit display type electronic time piece of claim 14, wherein:

each said digit display configuration is defined by a plurality of display segments;

said third digit display configuration consists of a cross-and-diagonal-cross-in-square alphanumeric configuration of said display segments; and said fourth digit display configuration consists of a ten segment alphanumeric configuration.

21. The digit display type electronic time piece of claim 20, wherein:

said punctuation display configuration consists of a colon.

22. The digit display type electronic time piece of claim 15, wherein:

said punctuation display configuration consists of a colon.

23. The digit display type electronic time piece of claim 16, wherein:

said punctuation display configuration consists of a colon.

24. The digit display type electronic time piece of claim 17, wherein:

said punctuation display configuration consists of a colon.

25. The digit display type electronic time piece of claim 18, wherein:

said punctuation display configuration consists of a colon.

26. The digit display type electronic time piece of claim 25, wherein:

said alpha character day of the week identification comprises a two letter alphabetical abbreviation for each such day.

27. The digit display type electronic time piece of claim 14, wherein:

said punctuation display configuration consists of a colon.

28. The digit display type electronic time piece of claim 14, wherein:

said mode control means further includes means automatically sequencing said decoder means and said time and date signal generating means into said time and date display output modes.

29. The digit display type electronic time piece of claim 28, wherein:

said alpha character day of the week identification comprises a two letter alphabetical abbreviation for each such day.

30. The digit display type electronic time piece of claim 28, wherein:

each said digit display configuration is defined by a plurality of display segments;

said first digit display configuration consists of a numeral one configuration; and said second, fifth and sixth digit display configurations each consists of a minus-in-square numeric configuration.

31. The digit display type electronic time piece of claim 28, wherein:

said punctuation display configuration consists of a colon.

32. The digit display type electronic time piece of claim 28, wherein:

each said digit display configuration is defined by a plurality of display segments;

said third digit display configuration consists of a cross-and-diagonal-cross-in-square alphanumeric configuration of said display segments; and said fourth digit display configuration consists of a ten segment alphanumeric configuration.

33. A digit display type electronic time piece comprising:

digit display means comprising first, second, third and fourth digit display configurations representing, respectively, the most, next most, next least and least significant digits of a display format;

said digit display means further comprising a punctuation display configuration between said second and third digit display configurations;

said first and second digit configurations comprising alphanumeric display configurations for selectively displaying hours, days and months and said third and fourth digit display configurations comprising numeric display configurations for selectively displaying minutes and daily dates;

time and date signal generating means for generating encoded time and date signals;

said date signals including day of the week identification and daily date information in a first date signal mode and including month identification and daily date information in a second date signal mode;

said time signals being numeric in character and said date signals being alphanumeric in character;

decoder means responsive to said time and date signals for generating display control codes;

mode control means selectively enabling said decoder means and said time and date signal generating means into time and date display output modes;

said digit display means being driven by said decoder means in said time display output mode to display hours in said first and second digit display configurations and minutes in said third and fourth digit display configurations;

said digit display means being driven by said decoder means in said first date signal mode to display alpha character day of the week identification in said first and second digit display configurations and numeric daily date information in said third and fourth digit display configurations; and said digit display means being driven by said decoder means in said second date signal mode to display alpha character month identification in said first and second digit display configurations and numeric daily date information in said third and fourth digit display configurations; and said digit display type electronic time piece further including:

language selection signal generating means for generating cyclically recurrent language signals each representing a kind of language in which said alpha character day of the week and month identifications are to be presented;

said decoder means being responsive to said cyclically recurrent language signals for enabling said first and second digit display configurations of said display means to display cyclically said day of the week identification and said month identification, respectively, in said first and second date signal modes in each of the particular selected languages represented by said language signals.

34. The digit display type electronic time piece of claim 33, wherein said alpha character day of the week and month identifications comprise two letter alphabetical abbreviations for each such day and month.

35. The digit display type electronic time piece of claim 33, wherein:

said third and fourth digit display configurations each consists of a minus-in-square numeric display configuration.

36. The digit display type electronic time piece of claim 33, wherein:

said third and fourth digit display configurations each consists of a minus-in-square numeric display configuration; and said punctuation display configuration consists of a colon.

37. The digit display type electronic time piece of claim 33, wherein said punctuation display configuration consists of a colon.

38. The digit display type electronic time piece of claim 36, wherein:

said alpha character day of the week and month identifications comprise two letter alphabetical abbreviations for each such day and month.

39. The digit display type electronic time piece of claim 37, wherein:

said alpha character day of the week and month identifications comprise two letter alphabetical abbreviations for each such day and month.

* * * * *